US009372005B2

(12) United States Patent
Raghavan et al.

(10) Patent No.: US 9,372,005 B2
(45) Date of Patent: Jun. 21, 2016

(54) HEAT EXCHANGER FOR OVEN

(71) Applicant: Alto-Shaam, Inc., Menomonee Falls, WI (US)

(72) Inventors: J. K. Raghavan, Mequon, WI (US); Jan Bartelick, Germantown, WI (US)

(73) Assignee: Alto-Shaam, Inc., Menomonee Falls, WI (US)

( * ) Notice: Subject to any disclaimer, the term of this patent is extended or adjusted under 35 U.S.C. 154(b) by 527 days.

(21) Appl. No.: 13/690,098

(22) Filed: Nov. 30, 2012

(65) Prior Publication Data

US 2014/0150769 A1 Jun. 5, 2014

(51) Int. Cl.

| | |
|---|---|
| ***F24C 15/32*** | (2006.01) |
| ***F28F 13/08*** | (2006.01) |
| ***F28D 1/047*** | (2006.01) |
| ***F28F 1/00*** | (2006.01) |
| ***F28D 1/02*** | (2006.01) |

(52) U.S. Cl.

CPC ..... *F24C 15/322* (2013.01); *F28D 1/024* (2013.01); *F28D 1/047* (2013.01); *F28F 1/006* (2013.01); *F28F 13/08* (2013.01)

(58) Field of Classification Search

CPC ..... F24C 15/32; F24C 15/322; F24D 1/047; F24F 1/006; F24F 13/08; F28F 13/08; F28F 1/006; F28D 1/024; F28D 1/047

USPC ..... 126/21 A

See application file for complete search history.

(56) References Cited

U.S. PATENT DOCUMENTS

| | | | | |
|---|---|---|---|---|
| 3,476,101 | A | 11/1969 | Ross | |
| 4,242,084 | A | 12/1980 | Jamaluddin | |
| 4,374,506 | A | 2/1983 | Whalen | |
| 4,484,561 | A * | 11/1984 | Baggott et al. | 126/21 A |
| 4,648,377 | A | 3/1987 | Van Camp | |
| 4,981,171 | A | 1/1991 | Tippmann | |
| 5,287,919 | A | 2/1994 | George, II et al. | |
| 5,301,654 | A | 4/1994 | Weber, III et al. | |
| 5,497,760 | A | 3/1996 | Alden et al. | |
| 5,517,980 | A | 5/1996 | Cappello et al. | |
| 5,530,223 | A | 6/1996 | Culzoni et al. | |
| 5,556,566 | A | 9/1996 | Cappello et al. | |
| 5,901,642 | A | 5/1999 | Su | |
| 5,915,372 | A * | 6/1999 | Wiedemann et al. | 126/21 A |
| 5,951,901 | A | 9/1999 | Douglas et al. | |
| 6,238,463 | B1 | 5/2001 | Helm | |

(Continued)

FOREIGN PATENT DOCUMENTS

| | | |
|---|---|---|
| DE | 4116544 | 1/1992 |
| DE | 19720736 | 11/1998 |

(Continued)

OTHER PUBLICATIONS

Blodgett Synergy Series Combi.

*Primary Examiner* — Alfred Basichas

(74) *Attorney, Agent, or Firm* — Boyle Fredrickson, S.C.

(57) ABSTRACT

An oven includes a heat exchanger with flattened segments providing low thermal resistance between flue gases being conveyed through the heat exchanger and a peripheral wall of the heat exchanger to increase the efficiency of heating of the peripheral wall of the heat exchanger to facilitate increasing a temperature of heated air that is delivered by a fan, across an outer surface of the peripheral wall of the heat exchanger, and through a cooking volume of the oven.

15 Claims, 4 Drawing Sheets

(56) References Cited

U.S. PATENT DOCUMENTS

| | | | | |
|---|---|---|---|---|
| 6,311,685 | B1 * | 11/2001 | Bassoli et al. | 126/21 A |
| 7,017,571 | B2 | 3/2006 | Smits et al. | |
| 7,223,943 | B2 | 5/2007 | Kohlstrung et al. | |
| 7,228,711 | B2 | 6/2007 | Taras et al. | |
| 7,325,480 | B2 * | 2/2008 | Gruhbaum et al. | 99/330 |
| 7,325,481 | B2 | 2/2008 | Helm | |
| 7,677,163 | B2 | 3/2010 | Helm | |
| 2004/0069295 | A1 * | 4/2004 | Rigamonti | 126/109 |

FOREIGN PATENT DOCUMENTS

| | | |
|---|---|---|
| DE | 20317601 | 3/2005 |
| DE | 202008010715 | 11/2008 |
| DE | 102007061286 | 6/2009 |
| DE | 102008029230 | 12/2009 |
| DE | 102008058718 A1 * | 5/2010 |
| EP | 0526768 | 7/1992 |
| EP | 0640310 | 5/1994 |
| EP | 0653593 | 10/1994 |
| EP | 0706014 | 7/1995 |
| EP | 0856705 | 11/1997 |
| EP | 1340945 | 3/2002 |
| EP | 1321720 | 9/2002 |
| EP | 1843101 B1 | 10/2007 |
| EP | 2072902 | 8/2008 |
| EP | 2072911 | 8/2008 |
| ES | 2124337 | 1/1995 |
| GB | 2347992 | 9/2000 |
| GR | 20000400143 | 5/2000 |
| IT | BZ95U000004 | 5/1995 |
| JP | 3021411 | 11/1995 |
| JP | 10246438 | 9/1998 |
| WO | WO2009074423 | 6/2009 |
| WO | WO2010100149 | 9/2010 |

* cited by examiner

HEAT EXCHANGER FOR OVEN

BACKGROUND OF THE INVENTION

The present invention relates to commercial ovens and, in particular, to heat exchangers for gas operated combination steam ovens.

Gas operated commercial ovens, such as combination ovens and other gas ovens, produce heat by delivering and burning gas in a burner tube. This produces heated flue gases that are directed to flow through a heat exchanger tube, eventually out of the oven, and are exhausted through a ventilation system. While the heated flue gases flow through the heat exchanger tube, heat is transferred from the heated flue gases to the material of the heat exchanger tube. A fan blows air across the heat exchanger tube, heating the air, and delivers the heated air into a cooking volume of the oven to cook the food.

Typical heat exchanger tubes are made from long lengths of round tubing that are bent into a looping configuration that is provided concentrically outside of a radial fan. Using round tubing provides low flow resistance for the flue gasses and allows the heat exchangers to be made using simple fabricating techniques and equipment such as rollers and benders that can typically form the entire looping configuration from a single piece of round tubing.

SUMMARY OF THE INVENTION

The present invention provides an oven that includes a heat exchanger with flattened tube segments designed so as to improve the heat transfer efficiency of the heat exchanger. The flattened tube segments of the heat exchanger provide a low thermal resistance during an exchange of heat between the heated flue gasses and the material of the heat exchanger by reducing the average path length between the flue gases and the oven interior through the wall of the tube. This is true even though the surface area of the tube is not changed. A lower thermal resistance allows the flattened tube segment to be more efficient at transferring heat from the flue gasses to the fan-driven air that will be delivered to the cooking volume for cooking food.

Specifically then, the present invention provides an oven having an oven housing defining a cooking volume and a fan communicating with the cooking volume for directing heated air through the cooking volume. A heat exchanger provides at least one tube extending around the fan for heating the heated air being directed by the fan through the cooking volume. The heat exchanger tube includes a first tube segment having a first passage extending longitudinally along an axis therethrough and having a width that is defined transversely across and through a middle portion of the first passage, and a second tube segment connected to the first tube segment and having a second passage communicating with the first passage and extending longitudinally along the axis through the second tube segment and having a width that is defined transversely across and through a middle portion of the second passage. The width of the second tube segment is smaller than the minimum width of the first tube segment and the first and second tube segments have substantially the same surface area per unit distance along the axis.

It is thus a feature of at least one embodiment of the invention is to provide an increase in the heat transfer in sections of the heat exchanger by flattening the tubing.

According to another aspect of the invention, the second tube segment may define a flattened portion that may provide a minor axis that extends across the middle portion of the second passage in a first direction and a major axis that is longer than the minor axis and extends across the middle portion of the second passage in a second direction that is different than the first direction. The width of the second passage may be defined by the minor axis and a height of the second passage may be defined by the major axis, whereby the second passage that is defined within the flattened portion may be narrower than it is tall. The length of the major axis of the second passage may be at least about twice the length of the minor axis of the second passage, whereby the second passage may be about one-half as narrow as it is tall. This may provide relatively small transverse spacing(s) between flue gasses within a passage and a confining wall of a tube segment through which heat from the flue gasses may be transferred.

It is thus a feature of at least one embodiment of the invention to effect a compromise between increased heat exchanger effectiveness and restriction of flue gas flow through the heat exchanger.

According to another aspect of the invention, the first passage of the first tube segment defines a circular or round cross-sectional perimeter shape and the second passage of the second tube segment defines a non-round cross-sectional perimeter shape. The non-round cross-sectional perimeter shape may be a flattened round shape or a generally oval shape, for example, an elliptical shape. Each of the first and second tube segments may be made from a piece of round tubing. At least part of the second tube segment may flattened from the respective piece of round tubing so that the second tube segment may define a pair of side walls that extend in a generally common direction and a pair of curved end walls that interconnect respective ends of the side walls to each other. The width of the second tube segment and, thus, the passage extending through the second tube segment may be defined between the side walls of the second tube segment and the passages of the first and second tube segments may have a common cross-sectional area. This may provide a tube segment that is relatively narrower and provides a lower thermal resistance and greater thermal conductance while allowing different segments of the heat exchanger to have different cross-sectional shapes while being made from a single type of tubing stock.

It is thus a feature of at least one embodiment of the invention to provide a heat exchanger that has different segments having different cross-sectional perimeter shapes for reduced thermal resistance and enhanced thermal conductance and that can be made from a single or relatively few types of stock.

According to another aspect of the invention, the heat exchanger may include straight sections and curved sections and the second tube segment may be arranged within one of the straight sections of the heat exchanger. The second tube segment defines a flattened portion and a transition portion connecting the first tube segment to the flattened portion of the second tube segment. The transition portion may taper inwardly from the first tube segment to the flattened portion of the second segment in a first direction and may expand outwardly from the first tube segment to the flattened portion of the second segment in a second direction. This may allow the flattened tube segments to be formed by flattening straight pieces of round tubing, without flattening the ends of the tube segments, and then welding or otherwise joining the non-flattened ends of the otherwise flattened pieces of round tubing to the round peripheral walls of round tubing to construct the overall heat exchanger.

It is thus a feature of at least one embodiment of the invention to provide a heat exchanger with modular sections that can be assembled as an overall configuration that includes straight segments with flattened portions.

According to another aspect of the invention, the flattened portions are arranged at angles. The flattened portions can be angularly aligned with respect to each other, with respect to walls of the oven, and/or with respect to air flow direction(s) of the fan provided within the heat exchanger. This may allow the flattened portions to function as louvers that can influence the flow direction of air being blown from the fan.

It is thus a feature of at least one embodiment of the invention to provide a heat exchanger with flattened portions that are arranged to enhance airflow patterns in the oven.

These particular features and advantages may apply to only some embodiments falling within the claims and thus do not define the scope of the invention.

DETAILED DESCRIPTION OF THE PREFERRED EMBODIMENT

Figure 1:
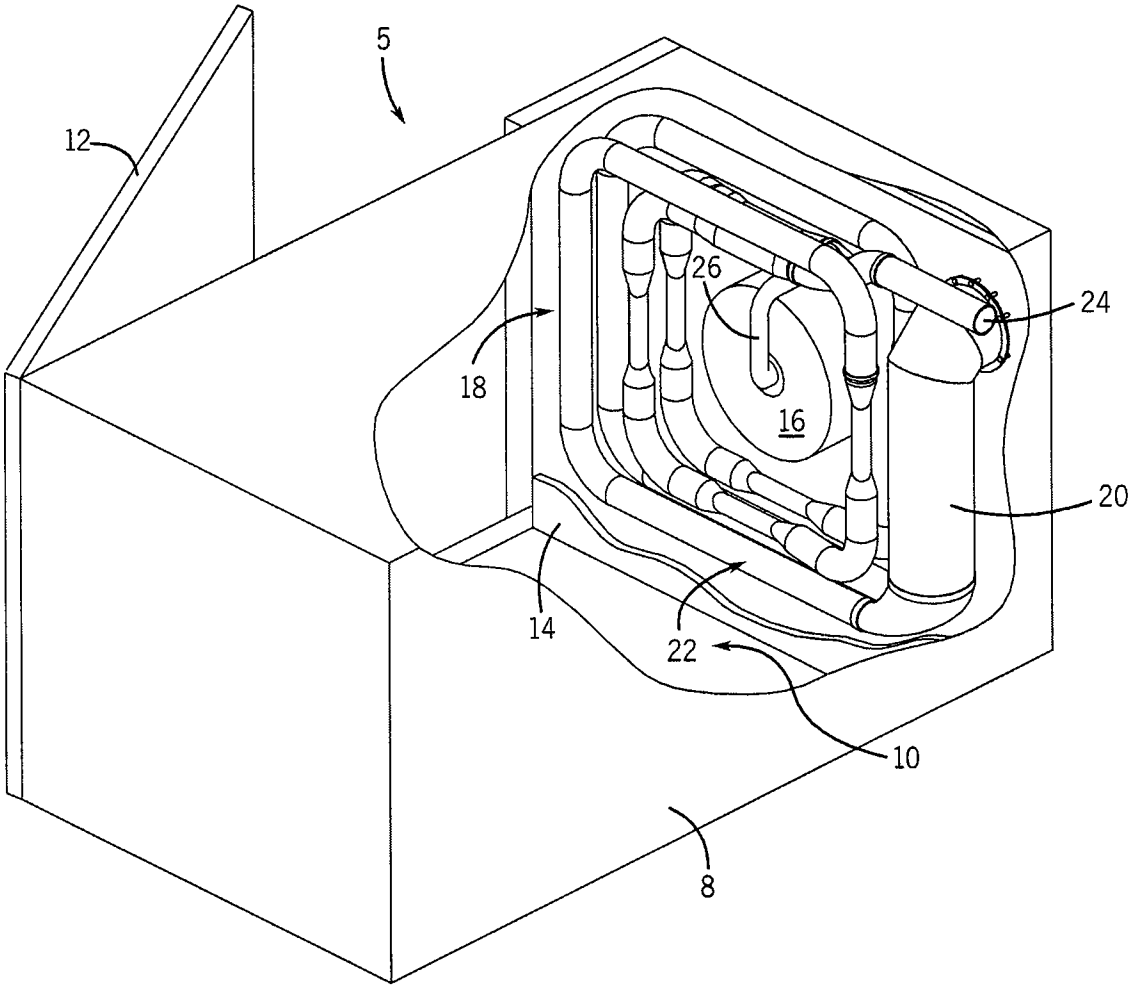
FIG. 1 is a simplified perspective view of an oven in partial cutaway showing a heat exchanger of the heat exchanger

Referring now to FIG. 1, a commercial oven 5, shown in a simplified and mostly schematic manner, is suitable for providing steam and convection air cooking as controlled by a controller (not shown) in a known manner. The oven 5 includes a housing 8 that defines a cooking volume 10 which is open toward a front of the housing 8. The cooking volume 10 is accessible through a door 12 including a glass vision panel, the door 12 connected by a hinge at one vertical side of the housing 8 to sealingly or otherwise close that cooking volume 10 during cooking operations. A gasket (not shown) may be provided in some embodiments to surround an opening of the cooking volume 10, covered by the door 12. A latch assembly (not shown) allows the door 12 to compress the gasket and be the retained in what may be a sealed position or to be released to allow the door 12 to open. A door sensor (not shown), for example, a micro switch, may provide a signal indicating whether the door 12 is open or closed by the latch assembly. Positioned within the housing 8 and communicating with the cooking volume 10 through a perforated panel 14 (shown mostly cut away) is a convection fan 16 forcing air in a radial direction away from the fan 16, past the heat exchanger system or heat source 18, and into the cooking volume 10 providing heat for cooking items in the cooking volume 10. The heat exchanger system or heat source 18 includes a burner tube 20, which can be oriented either vertical or horizontal, in which gas combustion occurs in a known manner to provide heated flue gasses that are directed through a heat exchanger 22 which is connected to an end of the burner tube 20. The heat exchanger 22 wraps around the fan 16 twice and directs the flue gasses along a generally coiling path about the fan 16, explained in greater detail elsewhere herein, and out of an outlet tube 24 that is connected to ductwork (not shown) for exhausting the flue gasses.

Still referring to FIG. 1, the heat source 18 further provides heat for the production of steam produced by a water jet 26 controlled by a valve (not shown) typically impinging on the fan 16 and a portion of the convection heating element 18 proximate to the fan 16. Ovens of this type are commercially available from the Alto-Shaam Inc. of Menomonee Falls, Wis., and are described generally in U.S. Pat. No. 6,188,045 "Combination Oven with Three Stage Water Atomizer" hereby incorporated by reference. One or more thermal sensors, for example, platinum RTD or thermocouple elements, may communicate with the cooking volume 10 to provide an electrical signal indicating a temperature within that volume 10.

Figure 2:
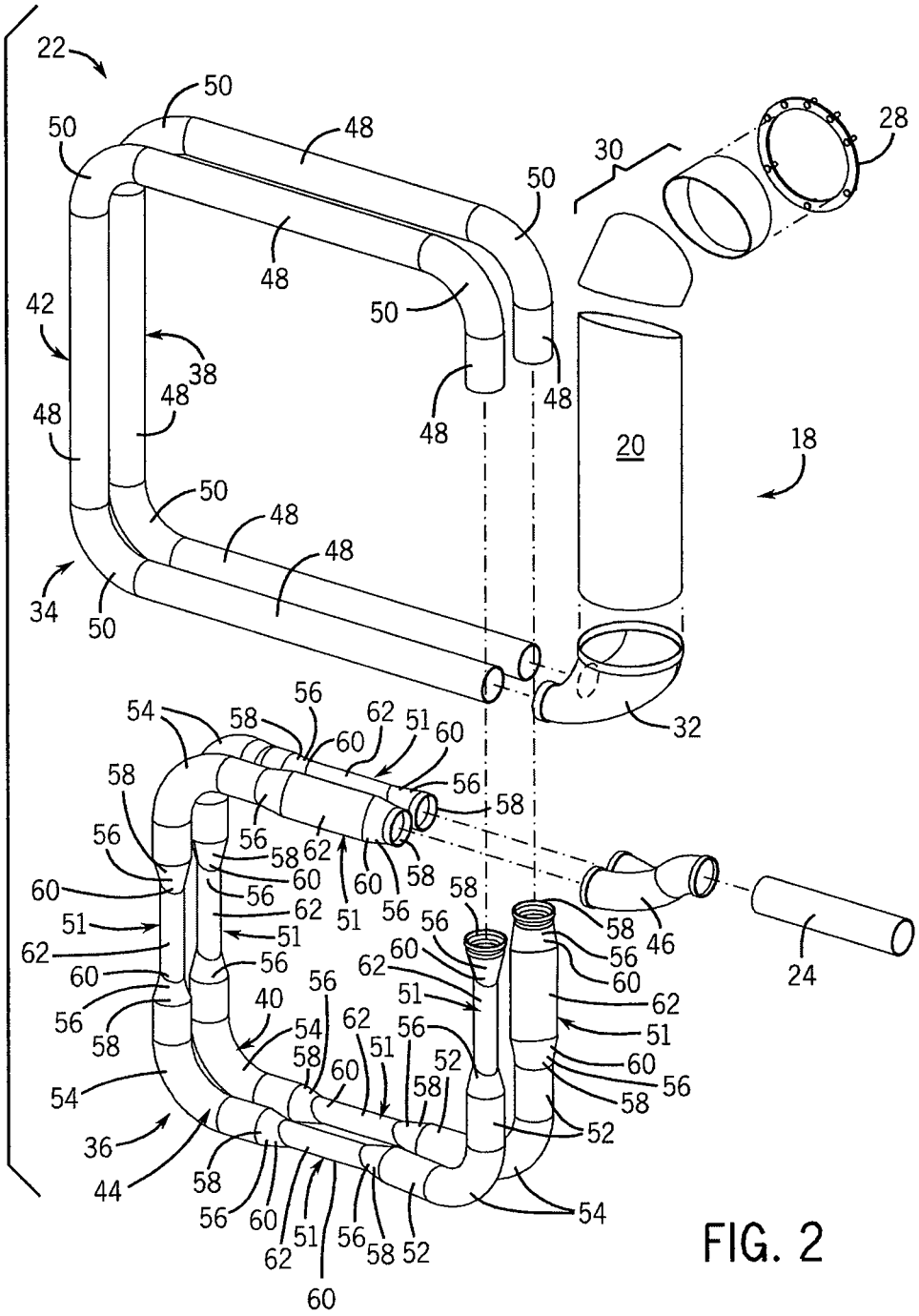
FIG. 2 is an exploded pictorial view of the heat exchanger of FIG. 1.

Referring now to FIG. 2, the heat exchanger or the heat source 18 can be made from stainless steel or other suitable metal materials, which may be provided as interconnected tube segments that may be interconnected by welding about the entire periphery of the abutting or otherwise engaging ends of the tube segments so as to provide a fluid-tight connection therebetween. The heating element 18 is supported in a suspended manner from engagements of the outlet tube 24 and a flange 28 to walls of the housing 8. The flange 28 is provided at an end of a multiple segmented elbow 30 at an upper end of the burner tube 20. A passage through the flange 28 and elbow 30 provide a routing path through which gas plumbing lines, which deliver gas to a burner assembly and electrical conductors that are operably connected to an igniter within the burner tube 20 extend, as is known. A splitter 32 is connected to a lower end of the burner tube 20 and has a circular shaped inlet with a relatively larger diameter and two outlets that have circular shapes and relatively smaller diameters that are the same size as each other and that are arranged generally perpendicularly to the inlet of the splitter 32. The heat exchanger 22 extends from the splitter 32 and includes an outer loop 34 and an inner loop 36. Each of the outer and inner loops 34, 36 includes a pair of hoops made from tubing, shown as back and front hoops 38, 40, 42, and 44 for the outer and inner loops 34, 36, respectively.

The back hoops 38, 40 of the outer and inner loops 34, 36 are connected to each other so that a continuously looping passage is provided that defines a first flow path through the heat exchanger 22. The first flow path extends from the burner tube 20 through a back outlet of the splitter 32 and continuously and sequentially through the outer loop back hoop 38 and the inner loop back hoop 40, then through a back inlet of a collector 46 that is connected to the outlet tube 24. The front hoops 42, 44 of the outer and inner loops 34, 36 are connected to each other so that a continuously looping passage is provided that defines a second flow path through the heat exchanger 22. The second flow path extends from the burner tube 20 through a front outlet of the splitter 32 and continuously and sequentially through the outer loop front hoop 42 and the inner loop front hoop 44, then through a front inlet of the collector 46 so the first and second flow paths merge in the collector 46 and the combined volume is directed out of the oven 5 through the outlet tube 24.

Figure 3:
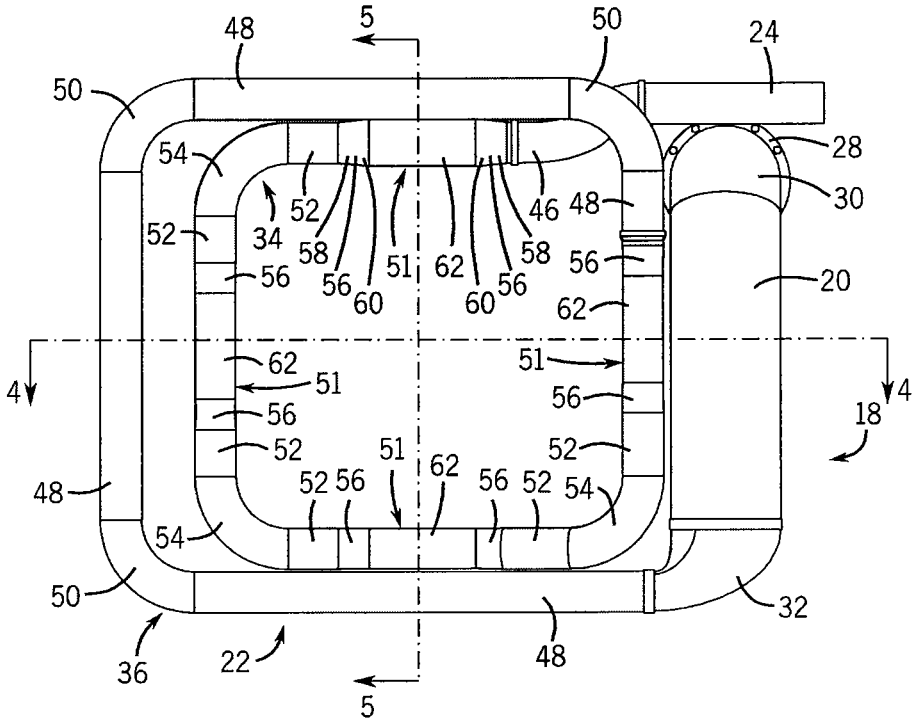
FIG. 3 is a front elevation view of the heat exchanger of FIG. 1.

Still referring to FIG. 2, the outer loop back and front hoops 38, 42 may be provided by tube segments that are made from lengths of round tubing stock, for example, 1⅝" or 1¾" outside diameter tubing. Each of the outer loop back and front hoops 38, 42 includes straight sections 48 and curved sections 50. As shown in FIGS. 2 and 3, the curved sections 50 are shown as being curved at about 90 degrees to provide rounded corners between respective pairs of straight sections 48. In this way, adjacent straight sections 48 are arranged at about 90 degrees with respect to each other so that the outer loop 34 provides a generally rectangular arrangement at the outside of the heat exchanger 22. The straight sections 48 at the ends of the outer loop back and front hoops 38, 42 that connect to the inner loop back and front hoops 40, 44 may be substantially shorter than other straight sections 48 within the outer loop 34.

Referring again to FIG. 2, the inner loop back and front hoops 40, 44 may be provided by tube segments that are made from lengths of round tubing stock which may have the same diameter(s) as the outer loop back and front hoops 38, 42, for example, 1⅝" or 1¾" outside diameter tubing. Each of the inner loop back and front hoops 40, 44 includes straight sections 51 and curved sections 54. As shown in FIGS. 2 and 3, like the curved sections within the outer loop 34, the curved sections 54 of the inner loop back and front hoops 40, 44 are shown as being curved at about 90 degrees to provide rounded corners between respective pairs of straight sections 51, so that adjacent straight sections 51 are arranged at about 90 degrees with respect to each other so that the inner loop 36 provides a generally rectangular arrangement at the inside of the heat exchanger 22, closer to the fan 16 (FIG. 1) than the outer loop 34.

Figure 4:
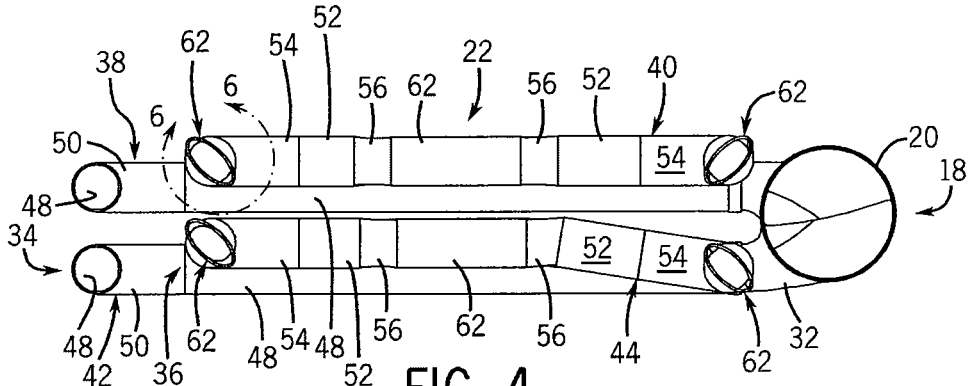
FIG. 4 is a cross-sectional view from above of the heat exchanger, taken at line 4-4 of FIG. 3.
Figure 5:
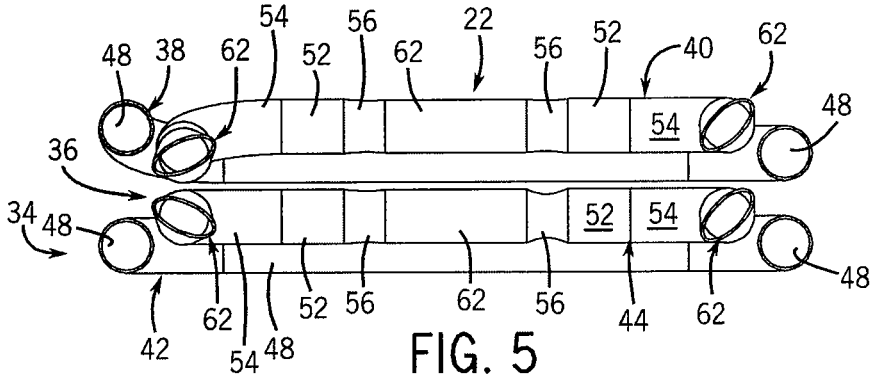
FIG. 5 is a cross-sectional view from the right of the heat exchanger, taken at line 5-5 of FIG. 3.
Figure 6:
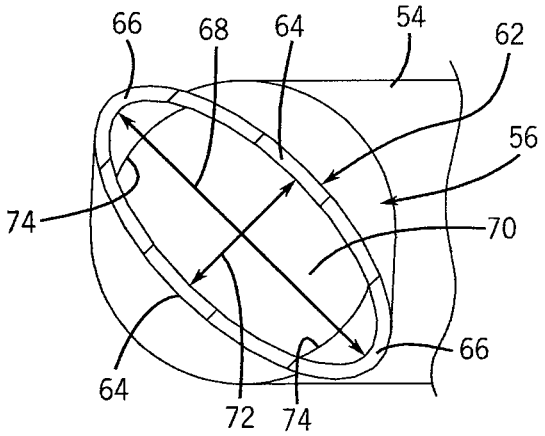
FIG. 6 is a close-up cross-sectional view of a flattened portion of the heat exchanger, taken at circle 6-6 of FIG. 4

Referring again to FIG. 2, each of the inner loop straight sections 51 includes a pair of tube segments 52 and other tube segments that provide a pair of transitions portions 56 that are arranged in longitudinal alignment and in generally opposite facing orientations with respect to each other. Each tube segment 52 is shown as being circular or round in cross-section. Each transition portion 56 has a first end, shown as a round end 58 that defines a round opening and that is connected to a respective one of the tube segments 52, and a second end, shown as a flattened end 60 with a non-round opening that connects to a tube segment that provides a flattened portion 62 of the straight section 51 and that extends longitudinally between respective pairs of the transition portions 56 (FIGS. 2 and 3). In this way, each transition portion 56 tapers inwardly from a round circumferential side wall of the tube segment 52 in a first direction. Each transition portion 56 expands outwardly from the round circumferential side wall of the tube segment 52, in a second direction that is shown as being generally perpendicular to the first direction. The non-round opening of the transition portion flattened end 60 may have the same cross-sectional perimeter shape as the flattened portion 62. As shown in FIGS. 4, 5, and 6, such non-round opening shape of the transition portion flattened end 60 and the entire flattened portion 62 provided between the pair of transition portions 56 may each be produced from a piece of round tubing stock material that is squeezed in a press to partially collapse the piece(s) of round tubing stock material in a transverse direction.

Referring now to FIG. 6, the cross-sectional perimeter shape of the flattened portion 62 is defined by a pair of side walls 64 that extend in a generally common direction and a pair of end walls 66 that interconnect respective ends of the side walls 64 to collectively define an oval, for example, an elliptical, perimeter shape. Accordingly, the side walls 64 are shown as being slightly arcuate and mirror images of each other about a major axis 68 that extends longitudinally along a centerline through a cross-section of the flattened portion 62, across a passage 70 that extends lengthwise through the flattened portion 62, and define a maximum width of the passage 70 and flattened portion 62. The end walls 66 extend in generally the same direction and are also arcuate, although have more curvature than the side walls 64, and are mirror images of each other about a minor axis 72 that extends transversely along a centerline through a cross-section of the flattened portion 62, across the passage 70 in a direction that is generally perpendicular to the major axis 68. In this regard, the length of the major axis 68 corresponds to a height of the passage 70, which corresponds to a height of the flattened portion 62. A length of the minor axis 72 defines a width of the passage 70, which corresponds to a width of the flattened portion 62, such that the passage 70 and thus flattened segment 62 are narrower than they are tall.

Still referring to FIG. 6, as shown, the height of the passage 70 and thus flattened portion 62 is about twice that of its corresponding width. In one exemplary embodiment, it is understood that the length of the major axis 68 and thus the height of the passage 70 and flattened portion 62 may be about two inches, whereas the length of the minor axis 72 and thus the width of the passage 70 and flattened portion 62 may be about one inch. In such an example, the greatest transverse distance between a middle portion of the passage 70 near the intersection of the major and minor axes 68, 72, and the closest heat conductive material provided by the flattened portion 62 would be about one-half inch, which is substantially less than if the flattened portion 62 had not been flattened but instead retained its pre-flattened round cross-sectional shape, providing a low thermal resistance and high thermal conductivity of the flattened portion 62 through the passage 70. That is because the relatively narrower gap across the width of the passage 70 provides relatively less space for which a gas(es) may act as an insulator in that direction, within the passage 70. The narrower and taller configuration of the passage 70 and flattened portion 62, when compared to its preceding round cross-sectional form, can be seen in FIG. 6 by comparing the oval cross-sectional perimeter shape of flattened portion 62 to an edge 74 of the flattened end 60 (FIG. 3) of the transition portion 56 that is aligned with an inner surface of the round circumferential sidewall of the tube segment 52 (FIG. 3).

Referring again to FIGS. 4, 5, and 6, the flattened portions 62 are shown as being arranged angularly with respect to the general arrangement of the heating element 18 and thus also angularly with respect to walls of the housing 8 of the oven 5 (FIG. 1). The flattened portions 62 shown toward the left-hand side of FIG. 4 are parallel to each other but angled with respect to other components of the heat exchanger 22. The flattened portions 62 shown toward the right-hand side of FIG. 4 are angled with respect to each other and to other components of the heat exchanger 22, so that the major axes (FIG. 6) of such flattened portions 62 converge toward a central portion of the heat exchanger 22. Furthermore, the transition portion 56 shown toward the bottom-right of FIG. 4 as part of the inner loop front hoop 44 includes a bend so that the tube-corresponding segment 52 is angled with respect to the respective flattened portion 52 of the inner loop front hoop 44, when viewed from above. In this arrangement, the upwardly extending flattened portions 62 shown in cross-section at the right-hand side of FIG. 4 are spaced at substantially, plus or minus about 5%, the same distance from the burner tube 10.

The flattened portions 62 shown toward the right-hand side of FIG. 5 are parallel to each other but angled with respect to other components of the heat exchanger 22. The flattened portions 62 shown toward the left-hand side of FIG. 5 are angled with respect to each other and to other components of the heat exchanger 22, so that the major axes (FIG. 6) of such flattened portions 62 converge toward a point that is located outside of the heat exchanger 22. The angularly arrangements of the flattened portions 62 allow the flattened portions 62 to act like louvers that can influence flow direction(s) or flow pattern(s) of cook air being moved by the fan 16 across the heat exchanger 22 to obtain heat before entering the cooking volume 10.

In this way, since the components of the heat exchanger 22 can be made from the same size and type of metal tubing, in which some components or portions thereof may be flattened to provide non-circular cross-sectional perimeter shapes, the heat exchanger 22 may provide first and second tube segments having different minimum widths, different maximum widths, and/or different cross-sectional perimeter shapes, even though the first and second tube segments having substantially the same surface area per unit distance along the respective longitudinal axis. For example, the first tube segment may be defined by one of the tube segments 52 and the second tube segment may be defined by the flattened portion 62 connected to such tube segment 52 by an intervening transition portion 56. Thus, the tube segment 52 and flattened portion 62 may provide a common surface area of their peripheral walls per unit distance along their aligned longitudinal axes, despite defining different minimum widths, maximum widths, and/or cross-sectional perimeter shapes. The first or second tube segment may instead be defined by the transition portion 56 and the other one of the first or second tube segment may be defined by the flattened portion 62. The first and second tube segments may be defined within the transition portion 56 itself, by the round end 58 and flattened end 60 that provide a common surface area of their peripheral wall portions per unit distance along the axis, despite having different minimum widths, maximum widths, and cross-sectional perimeter shapes. The first and second tube segments may be defined by other components or portions of components within the heat exchanger 22 that may provide a common surface area of their peripheral walls per unit distance along their a longitudinal axis, despite defining different minimum widths, maximum widths, and cross-sectional perimeter shapes. This provides a low thermal resistance during an exchange of heat between the heated flue gasses and the material of the heat exchanger by reducing the average path length between the flue gases and the oven interior through the wall of the tube.

Certain terminology is used herein for purposes of reference only, and thus is not intended to be limiting. For example, terms such as "upper", "lower", "above", "below", "clockwise", and "counterclockwise" refer to directions in the drawings to which reference is made. Terms such as "front", "back", "rear", "bottom", and "side" describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second", and other such numerical terms referring to structures do not imply a sequence or order unless clearly indicated by the context.

When introducing elements or features of the present disclosure and the exemplary embodiments, the articles "a", "an", "the", and "said" are intended to mean that there are one or more of such elements or features. The terms "comprising", "including", and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

References to a controller, computer or processor, or its equivalent can be understood to include one or more computational devices including microprocessors, field-programmable gate arrays, and application-specific integrated circuits that can implement state-aware logic and that can communicate in a stand-alone and/or a distributed environment(s), and can thus be configured to communicate via wired or wireless communications with other processors, where such one or more processor can be configured to operate on one or more processor-controlled devices that can be similar or different devices. Furthermore, references to memory, unless otherwise specified, can include one or more processor-readable and accessible memory elements and/or components that can be internal to the processor-controlled device, external to the processor-controlled device, and can be accessed via a wired or wireless network.

We claim:

1. An oven comprising:

an oven housing defining a cooking volume enclosed by oven walls;

a fan communicating with the cooking volume for directing heated air through the cooking volume;

a heat exchanger providing at least one tube extending around and encircling the fan for heating the heated air being directed by the fan through the cooking volume, the heat exchanger tube including:

a splitter separating the tube of the heat exchanger into two substantially parallel tubes each having a first and second tube segments, the first tube segment having a first passage extending longitudinally along an axis therethrough and having a width that is defined transversely across and through a middle portion of the first passage, and the second tube segment connected to the first tube segment and having a second passage communicating with the first passage and extending longitudinally along the axis through the second tube segment and defining a flattened portion having a width defined by a minor axis and a height defined by a major axis that is longer than the minor axis, wherein the first and second tube segments have substantially the same surface area per unit distance along the axis, and wherein the tube extending around the fan includes a set of series connected straight sections and curved sections wherein each respective straight section shares a common axis extending longitudinally therethrough the straight section and wherein the second tube segment is arranged within one of the straight sections of the heat exchanger and the major axis of the second tube segment is tipped with respect to the oven walls.

2. The oven of claim 1 wherein the width of the second passage is smaller than the width of the first passage and wherein the height of the second passage is greater than a height of the first passage.

3. The oven of claim 2 wherein the length of the major axis of the second passage is at least about twice the length of the minor axis of the second passage.

4. The oven of claim 3 wherein the flattened portion defines an oval cross-sectional shape.

5. The oven of claim 1 wherein the first passage of the first tube segment defines a circular cross-sectional perimeter shape and the second passage of the second tube segment defines a non-circular cross-sectional perimeter shape.

6. The oven of claim 5 wherein the cross-sectional perimeter shape of the second passage is a flattened round shape.

7. The oven of claim 5 wherein the second passage defines a cross-sectional perimeter shape that is generally oval.

8. The oven of claim 7 wherein each of the first and second tube segments is made from a piece of round tubing and wherein at least part of a length of the second tube segment is flattened so that the second tube segment defines a pair of side walls that extend in a generally common direction and a pair of curved end walls that interconnect respective ends of the side walls to each other, and wherein the minimum width of the second tube segment is defined between the side walls of the second tube segment.

9. The oven of claim 8 wherein the first and second passages of the first and second tube segments have substantially identical perimeter lengths.

10. The oven of claim 1 wherein the minimum width of the second tube segment is defined between the side walls of the flattened portion of the second tube segment.

11. The oven of claim 1 wherein the first and second tube segments extend longitudinally adjacent to each other and are arranged in the first straight section of the heat exchanger.

12. An oven comprising:

an oven housing defining a cooking volume;

a fan communicating with the cooking volume for directing heated air through the cooking volume;

a heat exchanger providing at least one tube extending around the fan for heating the heated air being directed by the fan through the cooking volume, the heat exchanger tube including:

a first tube segment having a first passage extending longitudinally along an axis therethrough and having a width that is defined transversely across and through a middle portion of the first passage, a second tube segment connected to the first tube segment and having a second passage communicating with the first passage and extending longitudinally along the axis through the second tube segment and having a width that is defined transversely across and through a middle portion of the second passage, wherein the width of the second tube segment is smaller than the minimum width of the first tube segment; and a splitter separating the tube of the heat exchanger into two substantially parallel tubes each having the first and second tube segments;

wherein the first and second tube segments have substantially the same surface area per unit distance along the axis, and wherein the second tube segments are positioned to be adjacent and parallel to each other and with axes of maximum width tipped with respect to an oven wall.

13. The oven of claim 12 wherein the axes of maximum width of the second tube segments are parallel.

14. The oven of claim 12 wherein the axes of maximum width of the second tube segments are not parallel.

15. An oven comprising:

an oven housing defining a cooking volume enclosed by oven walls;

a fan communicating with the cooking volume for directing heated air through the cooking volume;

a heat exchanger providing at least one tube extending around and encircling the fan for heating the heated air being directed by the fan through the cooking volume, the heat exchanger tube including:

a splitter separating the tube of the heat exchanger into two substantially parallel tubes, each having a first and second tube segments, the first tube segment having a first passage extending longitudinally along an axis therethrough and having a width that is defined transversely across and through a middle portion of the first passage, and the second tube segment connected to the first tube segment and having a second passage communicating with the first passage and extending longitudinally along the axis through the second tube segment and defining a flattened portion having a width defined by a minor axis and a height defined by a major axis that is longer than the minor axis, wherein the first and second tube segments have substantially the same surface area per unit distance along the axis, wherein the tube extending around the fan includes a set of series connected straight sections and curved sections wherein each respective straight section shares a common axis extending longitudinally therethrough the straight section and wherein the second tube segment is arranged within one of the straight sections of the heat exchanger.

* * * * *